US008720644B2

(12) United States Patent
Naranjo et al.

(10) Patent No.: US 8,720,644 B2
(45) Date of Patent: May 13, 2014

(54) ABOVEGROUND POOL CHILD LADDER SAFEGUARD DEVICE

(76) Inventors: Tony Floyd Naranjo, Clayton, NM (US); Frances Eva Naranjo, Clayton, NM (US)

( * ) Notice: Subject to any disclaimer, the term of this patent is extended or adjusted under 35 U.S.C. 154(b) by 0 days.

(21) Appl. No.: 13/564,193

(22) Filed: Aug. 1, 2012

(65) Prior Publication Data

US 2013/0031841 A1 Feb. 7, 2013

Related U.S. Application Data

(60) Provisional application No. 61/514,581, filed on Aug. 3, 2011.

(51) Int. Cl.
*E06C 7/00* (2006.01)
*E06C 7/18* (2006.01)

(52) U.S. Cl.
USPC ..... 182/106

(58) Field of Classification Search
USPC ..... 182/106, 107; 114/362; D25/68
See application file for complete search history.

(56) References Cited

U.S. PATENT DOCUMENTS

| | | | | | |
|---|---|---|---|---|---|
| 3,225,863 | A | * | 12/1965 | Ludlow | 182/104 |
| 3,311,195 | A | * | 3/1967 | Singer | 182/230 |
| 3,372,772 | A | * | 3/1968 | Singer | 182/230 |
| 3,414,919 | A | * | 12/1968 | Gust | 441/74 |
| 3,968,857 | A | | 7/1976 | Bryan | |
| 4,126,206 | A | * | 11/1978 | Becnel | 182/129 |
| 4,181,195 | A | * | 1/1980 | Clarke | 182/230 |
| 4,450,937 | A | * | 5/1984 | Broughton | 182/206 |
| 4,524,848 | A | | 6/1985 | Russo | |
| 4,579,197 | A | * | 4/1986 | Spurling | 182/106 |
| 4,664,225 | A | | 5/1987 | Coutier | |
| 5,215,346 | A | * | 6/1993 | Reitzloff et al. | 296/51 |
| 5,343,977 | A | | 9/1994 | Bryan | |
| 5,402,596 | A | * | 4/1995 | Gillming, Jr. | 43/54.1 |
| 5,421,428 | A | * | 6/1995 | Ingles | 182/106 |
| 5,441,126 | A | * | 8/1995 | Orrick | 182/106 |
| 5,682,960 | A | * | 11/1997 | Mobley et al. | 182/129 |
| 5,832,755 | A | | 11/1998 | Crilly | |
| 5,950,972 | A | * | 9/1999 | Irish | 248/210 |
| 6,102,156 | A | * | 8/2000 | Lipniarski | 182/118 |
| 6,298,945 | B1 | * | 10/2001 | Anders et al. | 182/68.1 |
| 6,364,057 | B1 | | 4/2002 | Cornejo et al. | |
| 6,520,523 | B2 | * | 2/2003 | Beck | 280/164.1 |
| 6,880,674 | B1 | * | 4/2005 | St-Hilaire | 182/106 |
| D525,369 | S | * | 7/2006 | Houze | D25/64 |
| 7,708,350 | B2 | * | 5/2010 | Bussey et al. | 297/452.17 |
| 7,717,231 | B2 | | 5/2010 | Horton | |
| 8,191,682 | B2 | * | 6/2012 | Lipniarski | 182/113 |
| 2006/0076188 | A1 | | 4/2006 | Horton | |

(Continued)

*Primary Examiner* — Charles A Fox
*Assistant Examiner* — Kristine Florio
(74) *Attorney, Agent, or Firm* — Buckingham Doolittle & Burroughs, LLC

(57) ABSTRACT

A safety device designed to attach to a ladder used for accessing an aboveground pool to prevent small children from entering the pool unattended. The safety device is also designed for use as an emergency rescue flotation device. The safety device comprises a body portion made of a light weight floating material and an attachment portion for temporarily engaging the ladder and holding the safety device in place over a plurality of ladder rungs. In the event of a water emergency, the safety device may be used to extend the reach of a rescuer from a safe position without the need for the rescuer to enter the water.

7 Claims, 4 Drawing Sheets

(56) References Cited

U.S. PATENT DOCUMENTS

2010/0012428 A1* 1/2010 Gibson et al. ..... 182/108
2012/0228058 A1* 9/2012 Dubois ..... 182/129
2012/0298448 A1* 11/2012 Houdyshell ..... 182/106
2012/0312635 A1* 12/2012 Randolph ..... 182/129

* cited by examiner

ABOVEGROUND POOL CHILD LADDER SAFEGUARD DEVICE

CROSS-REFERENCE

This application claims priority from Provisional Patent Application Ser. No. 61/514,581 filed Aug. 3, 2011.

FIELD OF THE INVENTION

This invention pertains generally to a safety device for protecting a pool ladder from unintended use by a small child, and more particularly to a dual purpose safety device for preventing small children from climbing a ladder used to access an aboveground pool and for use as an emergency rescue flotation device.

BACKGROUND

Aboveground swimming pools pose a significant threat to small children and toddlers that cannot swim. These pools frequently employ a ladder that is set up against or attached to the side of the pool for use in gaining access to the pool. These ladders are easily accessible by children. Toddlers and other small children are typically able to climb the ladder and enter the pool even without adult assistance. As the pools are semi-permanent, this creates a significant hazard for small children. If the pool owner does not immediately remove the ladder after use, it remains as a temptation for children to climb. Additionally, neighborhood children could easily find their way into the pool and accidently drown.

Consequently, there exists a need for a safety device designed to prevent a child from easily accessing and climbing the ladder of an aboveground swimming pool. The present invention discloses a device for ensuring that toddlers and other small children are unable to easily climb the ladder, thereby restricting the child's access to the pool. The safety device is also useful as an emergency flotation device in the event that anyone using the pool begins to struggle or drown.

SUMMARY

The following presents a simplified summary in order to provide a basic understanding of some aspects of the disclosed invention. This summary is not an extensive overview, and it is not intended to identify key/critical elements or to delineate the scope thereof. Its sole purpose is to present some concepts in a simplified form as a prelude to the more detailed description that is presented later.

The subject matter disclosed and claimed herein, in one aspect thereof, comprises a safety device designed for use in preventing unsupervised toddlers and small children from easily climbing an aboveground pool ladder. The safety device comprises a body portion capable of flotation and an attachment portion. The attachment portion is typically a pair of hook elements extending out of a top of the body portion. The pair of hook elements are used to engage a rung on the above ground pool ladder so that the body portion restricts access to a plurality of lower rungs, thereby preventing a child from easily climbing the ladder once the safety device is in place.

Furthermore, in the preferred embodiment of the invention, the pair of hook elements are adjustable so that the safety device can accommodate different sized ladders. A first side rail and a second side rail extend rearward from the body portion to help keep the safety device centered on the ladder. Additionally, in the event of a water emergency, the safety device is useable as an emergency flotation device for rescue. The safety device extends the reach of a rescuer from a safe position without the need to enter the water during the rescue.

To the accomplishment of the foregoing and related ends, certain illustrative aspects are described herein in connection with the following description and the annexed drawings. These aspects are indicative of the various ways in which the principles disclosed herein can be practiced and all aspects and equivalents thereof are intended to be within the scope of the claimed subject matter. Other advantages and novel features will become apparent from the following detailed description when considered in conjunction with the drawings.

DETAILED DESCRIPTION

Figure 1:
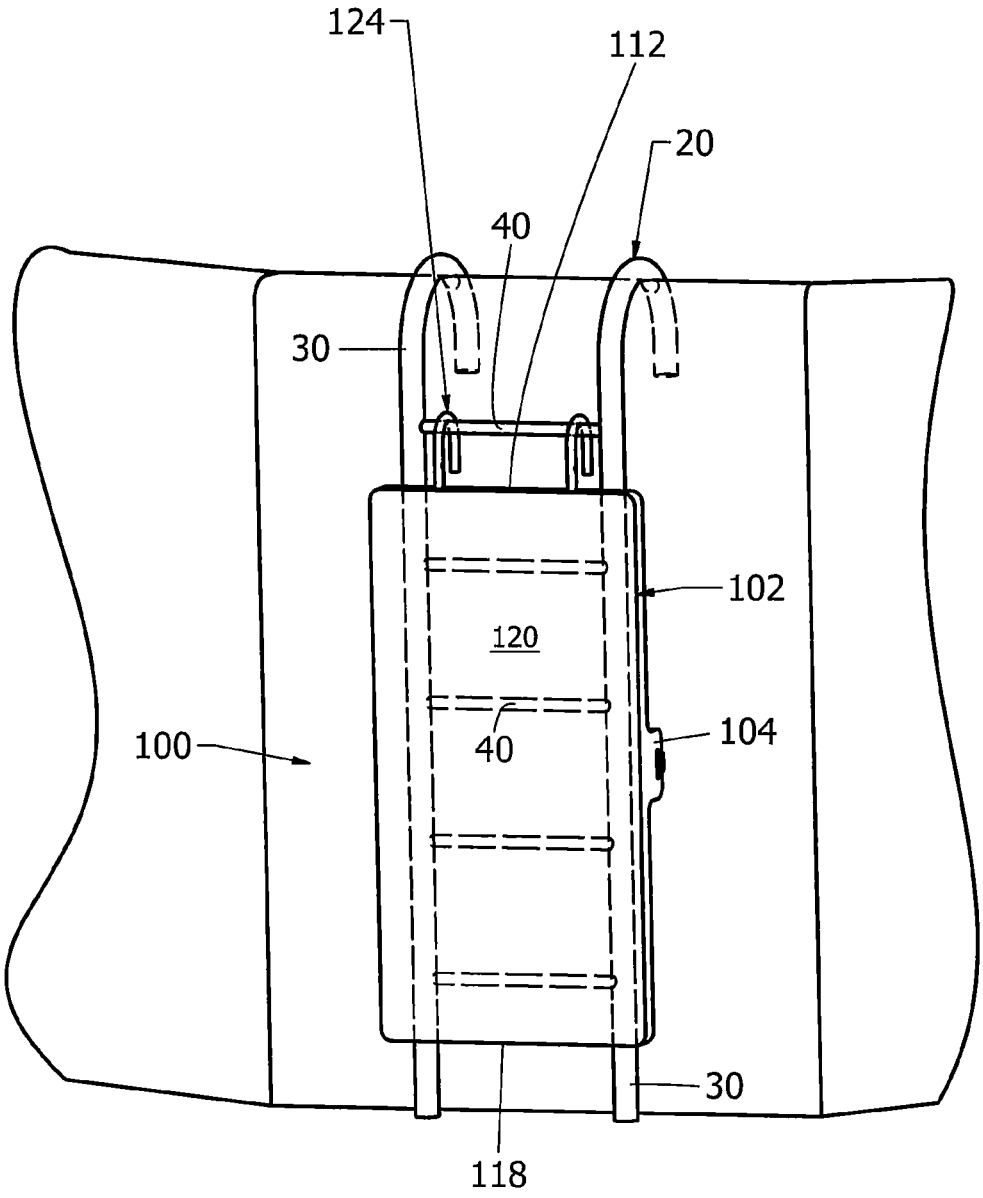
FIG. 1 illustrates a front perspective view of a safety device in accordance with the disclosed architecture.

Reference is now made to the drawings, wherein like reference numerals are used to refer to like elements throughout. In the following description, for purposes of explanation, numerous specific details are set forth in order to provide a thorough understanding thereof. It may be evident, however, that the novel embodiments can be practiced without these specific details. In other instances, well known structures and devices are shown in block diagram form in order to facilitate a description thereof. The intention is to cover all modifications, equivalents, and alternatives falling within the spirit and scope of the claimed subject matter.

The present invention discloses a safety device for preventing small children from inadvertently entering an aboveground pool via an above ground pool ladder. The safety device comprises a body portion, typically made from molded plastic allowing the safety device to float. To limit access to the aboveground pool ladder, an attachment portion allows the safety device to hang from a rung of the aboveground pool ladder so that the body portion substantially covers a plurality of lower rungs, thereby restricting access to the pool via the ladder while the safety device is in place. Furthermore, in the event of a water emergency, the safety device is useable as an emergency flotation device that extends the reach of a rescuer from a safe position outside of the pool.

Unless built into a deck, access to an aboveground pool is normally by means of an aboveground pool ladder 20. The aboveground pool ladder 20 typically comprises a pair of rails 30 and a plurality of rungs 40. The pair of rails 30 hang or extend over a rim of the above ground pool to assist in entry and egress.

Figure 2:
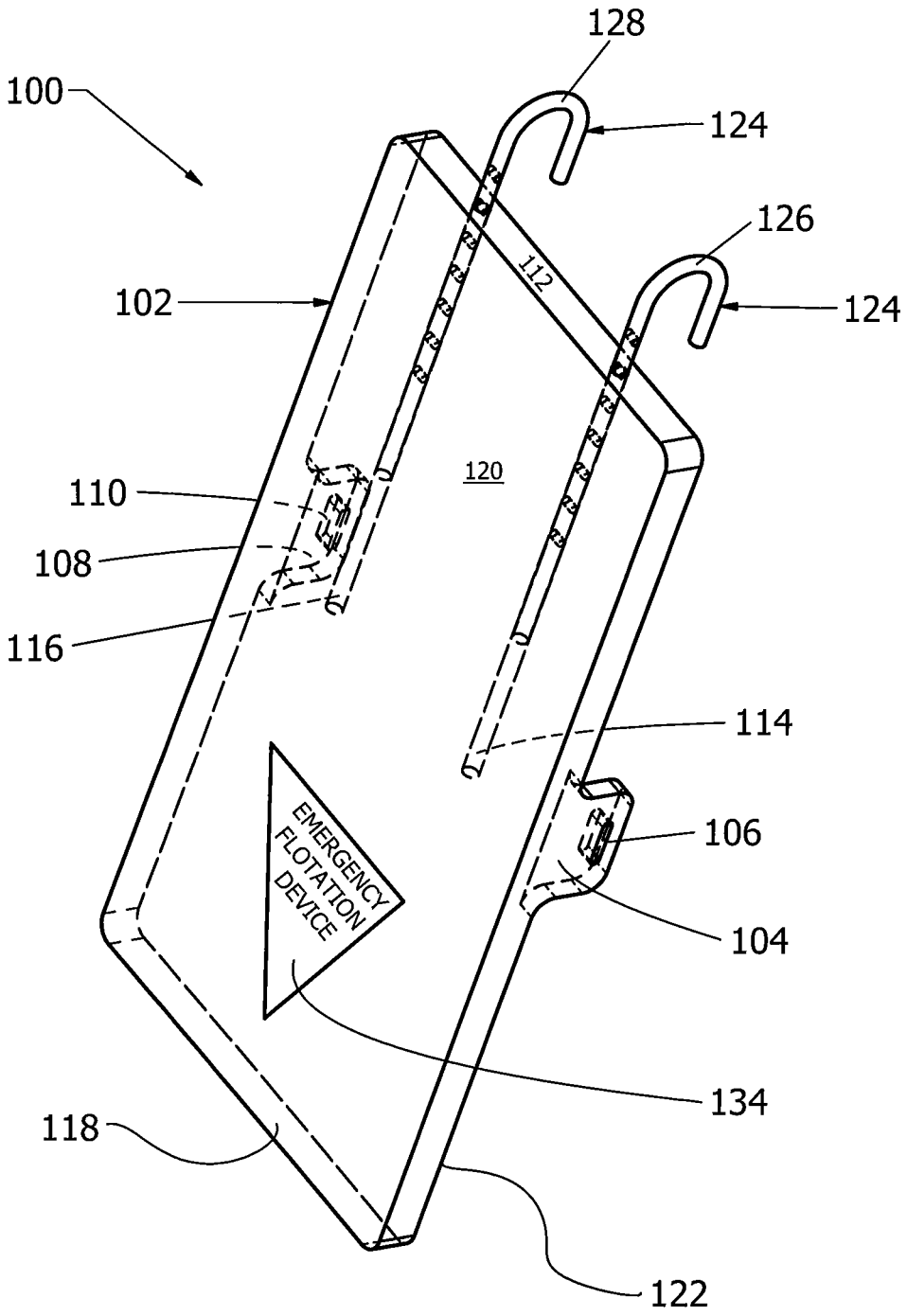
FIG. 2 illustrates a front perspective view of the safety device in accordance with the disclosed architecture.

Referring initially to the drawings, FIGS. 1 and 2 illustrate a safety device 100 useable in restricting an unintended use of an aboveground pool ladder 20 by a toddler or a small child. While the safety device 100 is preferably used with the aboveground pool ladder 20, other intended uses comprise playground ladders, step ladders, extension ladders, and the like. The safety device 100 comprises a body portion 102 and an attachment portion 124. The body portion 102 is preferably constructed from plastic, however any other suitable material known in the art that floats, such as wood, polymers, and the like may be used without affecting the overall scope of the invention. The body member 102 may be solid in construction, such as comprising a solid piece of plastic, or the body member 102 may be substantially hollow. If substantially hollow, the body member 102 will typically be a semi-rigid casing made from molded plastic. To improve rigidity, structural ribs or support members (not shown) may be molded into or otherwise affixed to the body member 102 as needed. Additionally, if substantially hollow, the body member 102 may be filled with a light weight floatable material (not shown) such as a closed-cell foam, structural foam, Styrofoam®, and the like.

Generally, the body portion 102 is substantially rectangular in shape with rounded edges. However, any shape that may protect the aboveground pool ladder 30 may be used, such as an embodiment where the body portion 102 is generally ovoid or shaped like a surfboard. When rectangular in shape, the body portion 102 typically is approximately between $\frac{1}{8}^{th}$ and one inch in thickness. Generally the body portion 102 is approximately between 30 and 42 inches in length and approximately between 14 and 20 inches in width. However the dimensions of the body portion 102 are chosen to correspond to the dimensions of the aboveground pool ladder 20 so they may vary depending on the dimensions required. For example, to fit a common generic aboveground pool ladder, the body portion 102 would be approximately 36 inches in length and approximately 18 inches in width. These dimensions would allow several of the plurality of rungs 40 to be protected across an entire width of the aboveground pool ladder 20.

Figure 3:
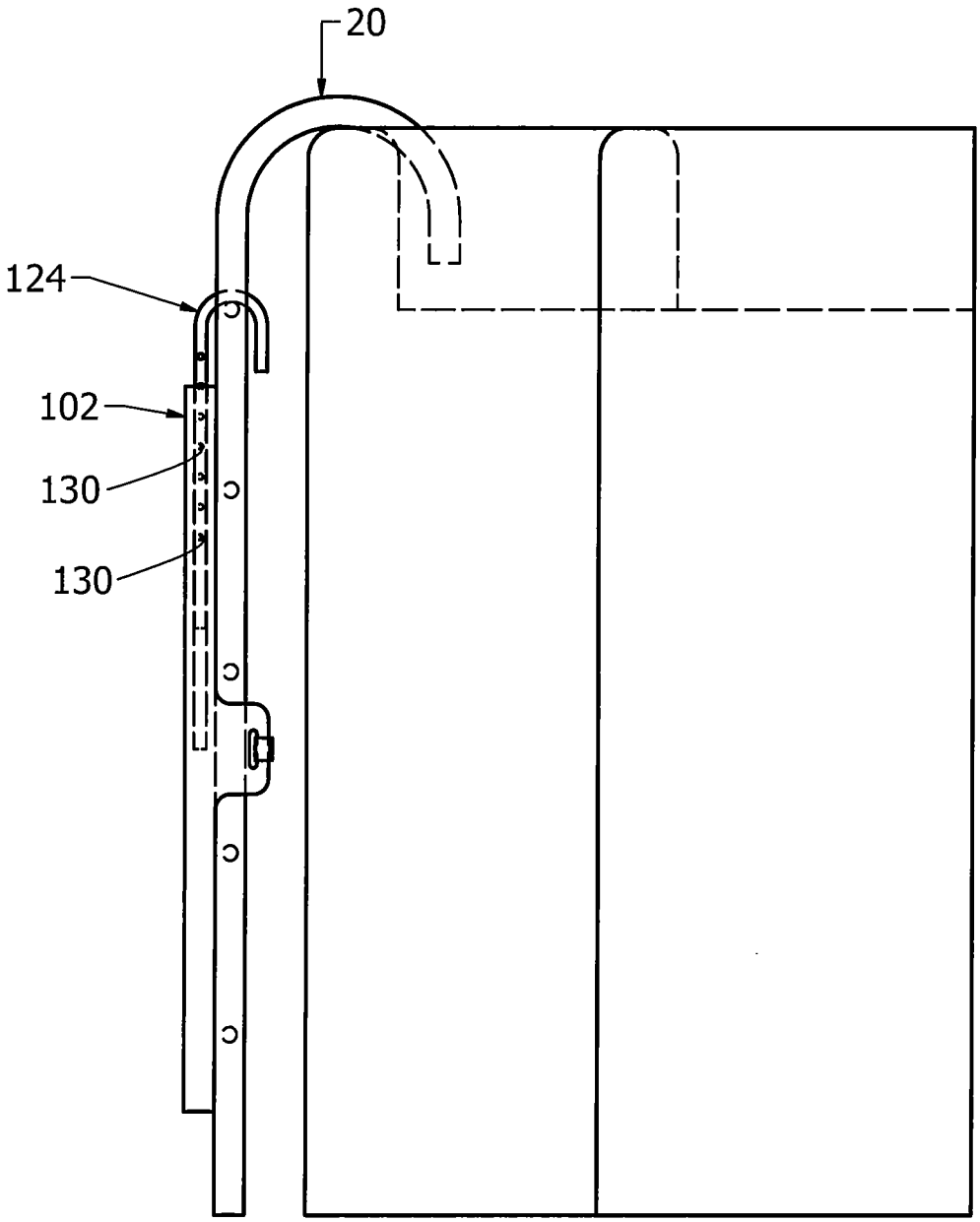
FIG. 3 illustrates a side view of the safety device in accordance with the disclosed architecture.
Figure 4:
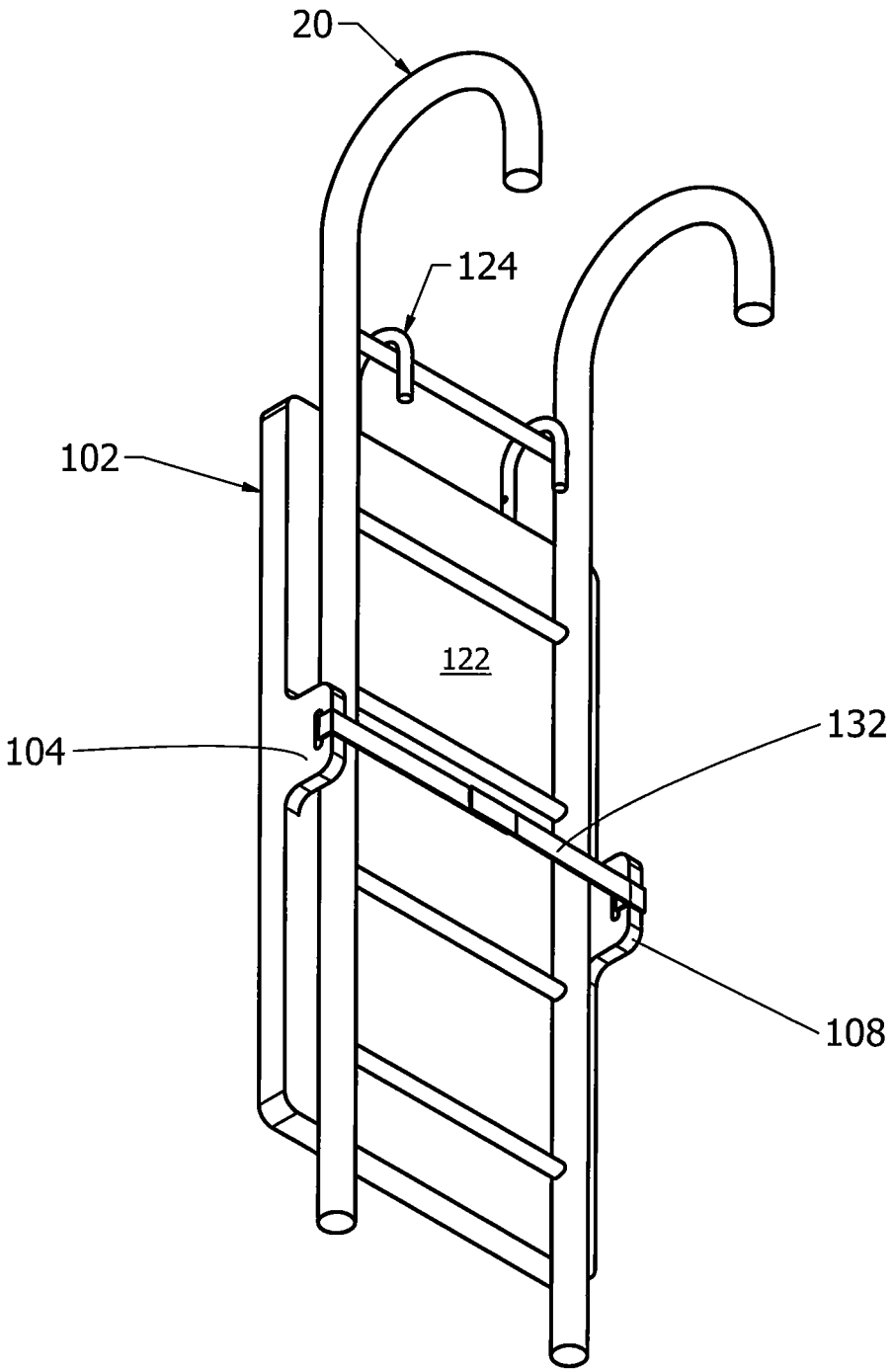
FIG. 4 illustrates a rear perspective view of the safety device in accordance with the disclosed architecture.

The body portion 102 comprises a first side rail element 104 and a second side rail element 108. As illustrated in FIGS. 3 and 4, the first side rail element 104 and the second side rail element 108 extend rearwardly toward the aboveground pool when the safety device 100 is in place on the aboveground pool ladder 20. When in use, the first side rail element 104 and the second side rail element 108 will abut or run substantially adjacent to at least a portion of the pair of side rails 30, thereby limiting side to side movement of the body portion 102 by means of friction or contact. The limitation of side to side movement aids in keeping the safety device 100 substantially in position on the aboveground pool ladder 20 and in limiting access to the plurality of rungs 40 by a child. Additionally, when in place, a back 122 of the body portion 102 will face rearward toward the aboveground pool and lie alongside and substantially limit access to at least two of the plurality of rungs 40, and a front 120 of the body portion 102 will face outward away from the aboveground pool.

As illustrated in FIG. 2, typically the first side rail element 104 comprises a first handle element 106, and the second side rail element 108 comprises a second handle element 110. While preferable, the first and second handle elements 106 and 110 are not required, and the inventor contemplates an embodiment without them. However, the first and second handle elements 106 and 110 are advantageous as handholds when the safety device 100 is used as an emergency flotation device. For example, in the event of a near drowning, a rescuer can hold the safety device 100 out over the water by the first and/or second handle elements 106 and 110 to extend the rescuer's reach without the need to and risk associated with entering the water to attempt the rescue. Additionally, the first and second handle elements 106 and 110 may be of any size and shape as contemplated by one of ordinary skill in the art.

The body element 102 further comprises a top 112 of the body portion 102 and a bottom 118. The bottom 118 may rest on the ground or may be elevated above ground level depending on the preference of the user. The attachment portion 124 extends from or out of the top 112 of the body portion 102 and engages one or more of the plurality of rungs 40, thereby allowing the body portion 102 to cover more than one of the lower plurality of rungs 40. The attachment portion 124 generally comprises a first hook element 126 and a second hook element 128. Both the first hook element 126 and the second hook element 128 each comprise a cane or hook shaped shaft constructed of plastic or metal. The cane or hook shaped shaft may be embedded or otherwise affixed to the top 112 of the body portion 102, or may be attached to the back 122 of the body portion 102. For example, the first hook element 126 and the second hook element 128 may be permanently molded into the top 112 of the body portion 102 so that the safety device 100 remains consistently at a fixed length.

Alternatively, the first hook element 126 and the second hook element 128 may be slidably adjustable. The body portion 102 may further comprise a first channel 114 and a second channel 116 embedded within the body portion 102 extending inward from the top 112 of the body portion 102. The first channel 114 and the second channel 116 may be smooth bore plastic tubes, screw threaded plastic tubes, bore holes, free space, and the like. The embodiment illustrated in FIG. 2 shows the first channel 114 and the second channel 116 as two substantially smooth-bore plastic tubes of a slightly larger diameter than the first hook element 126 and the second hook element 128. The first hook element 126 and the second hook element 128 are located partially within and slideably engage the first channel 114 and the second channel 116 respectively and extend from the top of the body portion 112.

The first hook element 126 and the second hook element 128 are generally slideably adjustable within the first channel 114 and the second channel 116 so that a user may easily change the overall length of the safety device 100. For example, the body portion 102 may substantially restrict access to at least a lower two of the plurality of rungs 40 while the first hook element 126 and the second hook element 128 engage a top rung of the aboveground pool ladder 20 holding the safety device 100 in position. However, the first hook element 126 and the second hook element 128 are each fixable at a plurality of positions within the first channel 114 and the second channel 116 so that the safety device 100 may be usable on a variety of different sized ladders. The first hook element 126 and the second hook element 128 may frictionally engage the first channel 114 and the second channel 116. Alternatively a plurality of position fixing elements 130 as seen in FIG. 3, such as pins, rods, clips, adjustable buttons, and the like may be used to adjust the length of the attachment portion 124. For example, buttons or pins similar to those used on portable tent shelters that snap into a plurality of holes (not shown) to fix the length may be operated by pushing or pulling as the first hook element 126 and the second hook element 128 are adjusted.

When in use the first hook element 126 and the second hook element 128 typically face rearwardly toward the aboveground pool extending over and engaging one of the plurality of rungs 40, The first hook element 126 and the second hook element 128 may comprise safety or snap back hooks so that the first hook element 126 and the second hook element 128 can pivot about an axis when not in use. Additionally, the entire attachment portion 124 may be removable. As such, the first hook element 126 and the second hook element 128 may be completely detached and removed from the first channel 114 and the second channel 116. For example, as the body portion 102 floats on water, the safety device 100 may be used without the first hook element 126 and the second hook element 128 as a floating toy or rescue device.

As illustrated in FIG. 4, a securing element 132 may be removably attached to the first side rail element 104 and/or the second side rail element 108. The securing element 132 is preferably a pair of straps with hook and loop fasteners, but may comprise strapping, webbing, rope, and the like. The securing element 132 generally helps secure the body portion 102 to the above ground pool ladder 20 for additional stability. However, in the event of an emergency, the securing element 132 may be used like a throw rope. The rescuer could toss the body portion 102 into the pool while holding on to the securing element 132, thereby extending the rescuer's reach. The safety device 100 may also be hung from the side of the pool for use as a rescue device. Additionally, the body portion 102 may further comprise an instructional element 134 as seen in FIG. 2, to inform and/or instruct users of how to use the safety device 100 in the event of an emergency.

Other variations are within the spirit of the present invention. Thus, while the invention is susceptible to various modifications and alternative constructions, a certain illustrated embodiment thereof is shown in the drawings and has been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein. Variations of those preferred embodiments may become apparent to those of ordinary skill in the art upon reading the foregoing description. The inventor expects skilled artisans to employ such variations as appropriate, and the inventor intends for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A safety device for use in protecting an aboveground pool ladder from unintended use by a child and as an emergency flotation device, the aboveground pool ladder comprising a pair of rails and a plurality of rungs, and the safety device comprising:

a hollow body portion comprising a top, a bottom, a pair of sides, an inside surface, and an outside surface, wherein the body portion is buoyant; and a first and a second side rail element each attached to one of the pair of sides for abutting at least a portion of the pair of rails, a first and a second channel embedded within the body portion which penetrate the top of the body portion and extend inwardly from the top of the body portion toward the bottom without penetrating the inside surface, the outside surface, or the bottom; and a removable attachment portion, wherein the removable attachment portion comprises a first and a second hook element located within the first and the second channels and extends through the top of the body portion for adjustably engaging one of the plurality of rungs; and a securing element attached to the first and the second side rail elements.

2. The safety device of claim 1, wherein the first and the second channel each comprise a smooth bore.

3. The safety device of claim 1, wherein the first and the second channel each comprise a threaded bore.

4. The safety device of claim 2, wherein the first and the second hook elements are adjustable within the first and the second channels and are fixable in place at a plurality of positions within the first and the second channels.

5. The safety device of claim 4, wherein the first and the second channels are approximately one half of a length of the body portion.

6. The safety device of claim 5, wherein the safety device is useable as an emergency flotation device when the first and the second hook elements are removed from the first and the second channel.

7. The safety device of claim 6, wherein the securing element is a pair of straps with hook and loop fasteners and extends the reach of the safety device when used as an emergency flotation device.

* * * * *